US011814738B2

(12) United States Patent
Van Den Bosch et al.

(10) Patent No.: US 11,814,738 B2
(45) Date of Patent: Nov. 14, 2023

(54) ELECTROCHEMICAL PRODUCTION OF FORMATE

(71) Applicant: Avantium Knowledge Centre B.V., Amsterdam (NL)

(72) Inventors: Bart Van Den Bosch, Amsterdam (NL); Marta Catarina Costa Figueiredo, Amsterdam (NL); Klaas Jan Pieter Schouten, Amsterdam (NL); Marie Brands, Amsterdam (NL); Brian James Rawls, Amsterdam (NL); Matthew Francis Philips, Amsterdam (NL)

(73) Assignee: Avantium Knowledge Centre B.V., Amsterdam (NL)

( * ) Notice: Subject to any disclaimer, the term of this patent is extended or adjusted under 35 U.S.C. 154(b) by 0 days.

(21) Appl. No.: 17/795,148

(22) PCT Filed: Jan. 28, 2021

(86) PCT No.: PCT/EP2021/052044
§ 371 (c)(1),
(2) Date: Jul. 25, 2022

(87) PCT Pub. No.: WO2021/152054
PCT Pub. Date: Aug. 5, 2021

(65) Prior Publication Data

US 2023/0057465 A1 Feb. 23, 2023

(30) Foreign Application Priority Data

Jan. 30, 2020 (EP) ..... 20154474

(51) Int. Cl.
*C25B 3/07* (2021.01)
*C25B 3/23* (2021.01)
(Continued)

(52) U.S. Cl.
CPC ..... *C25B 3/07* (2021.01); *C25B 3/23* (2021.01); *C25B 3/26* (2021.01); *C25B 9/19* (2021.01); *C25B 11/032* (2021.01); *C25B 11/075* (2021.01)

(58) Field of Classification Search
CPC ..... C25B 3/07; C25B 3/23; C25B 3/26
(Continued)

(56) References Cited

U.S. PATENT DOCUMENTS

2013/0118910 A1* 5/2013 Teamey ..... C07C 29/58 205/462
2014/0227634 A1 8/2014 Gulla et al.
(Continued)

FOREIGN PATENT DOCUMENTS

WO 2019141827 A1 7/2019
WO WO-2021122323 A1 * 6/2021 ..... C25B 11/032

OTHER PUBLICATIONS

Li et al., "Nickel-Molybdenum Nitride Nanoplate Electrocatalysts for Concurrent Electrolytic Hydrogen and Formate Productions," Nature Communications (Nov. 25, 2019), vol. 10, No. 1, pp. 1-12. (Year: 2019).*

(Continued)

*Primary Examiner* — Edna Wong
(74) *Attorney, Agent, or Firm* — Suiter Swantz pc llo

(57) ABSTRACT

The invention concerns a process for the electrochemical production of formate. The process is performed in an electrochemical cell comprising a cathode compartment containing a cathode, an anode compartment containing a nickel-based anode and an ion exchange membrane separating the anode compartment from the cathode compartment. The process comprises the following steps: (a) feeding an anolyte comprising at least one polyol to the anode compartment; (b) feeding a catholyte comprising $CO_2$ to the
(Continued)

cathode compartment; (c) and applying a voltage difference between the cathode and the anode such that at the cathode $CO_2$ is reduced to formate and at the anode the at least one polyol is oxidized to formate.

13 Claims, 5 Drawing Sheets

(51) Int. Cl.
*C25B 3/26* (2021.01)
*C25B 11/032* (2021.01)
*C25B 9/19* (2021.01)
*C25B 11/075* (2021.01)

(58) Field of Classification Search
USPC ..... 205/440, 413
See application file for complete search history.

(56) References Cited

U.S. PATENT DOCUMENTS

2015/0112037 A1* 4/2015 Eastham ..... C12Y 114/13022
526/329.7
2019/0055656 A1* 2/2019 Kenis ..... C25B 3/25
2019/0127865 A1* 5/2019 Li ..... C25B 3/26
2022/0259746 A1* 8/2022 Wang ..... C25B 11/044
2022/0411942 A1* 12/2022 Ansovini ..... C25B 15/02

OTHER PUBLICATIONS

Berchmans, et al., Electrooxidation of alcohols and sugars catalysed on a nickel oxide modified glassy carbon electrode,Journal of Electroanalytical Chemistry,vol. 394, Issues 1-2, 1995, pp. 267-270, ISSN 1572-6657, https://doi.org/10.1016/0022-0728(95)04099-A.
Hori, et al., (1994). Electrocatalytic process of CO selectivity in electrochemical reduction of CO2 at metal electrodes in aqueous media. Electrochimica Acta, 39, 1833-1839.
International Search Report and Written Opinion, dated Apr. 20, 2021 for PCT/EP2021/052044.
Li, et al. Nickel-molybdenum nitride nanoplate electrocatalysts for concurrent electrolytic hydrogen and formate productions. Nat Commun 10, 5335 (2019). https://doi.org/10.1038/s41467-019-13375-z.
Weaver, et al., (1991). Applications of Real-Time FTIR Spectroscopy to the Elucidation of Complex Electroorganic Pathways: Electrooxidation of Ethylene Glycol on Platinum, Gold, and Nickel in Alkaline Solution. Journal of the American Chemical Society, 113, 9506-9513.

* cited by examiner

ELECTROCHEMICAL PRODUCTION OF FORMATE

FIELD

The present invention is in the field of electrochemistry, especially in the electrochemical conversion of carbon dioxide and polyols to formate.

BACKGROUND ART

The electrochemical conversion of carbon dioxide into economically valuable materials such as fuels and industrial chemicals or intermediate products thereof is gaining interest in view of mitigating the emission of carbon dioxide into the atmosphere, which is responsible for damaging effects such as climate alterations, changes in pH of seawater, melting of polar ice and sea level rise. A mechanism for mitigating emissions is to convert carbon dioxide into economically valuable materials such as fuels and industrial chemicals. Although several electrochemical reductions of carbon dioxide have been proposed in the art, in order to use this in an economically viable process for large scale conversion of carbon dioxide, the reduction reaction at the cathode should be coupled with a suitable oxidation reaction at the anode. US 2019/0055656 A1 describes a process for the co-electrolysis of carbon dioxide and glycerol or glucose. It is mentioned that the main products of the electroreduction of carbon dioxide are carbon monoxide, formate, ethylene and ethanol; the main products of the electrooxidation of glycerol or glucose using a Pt black anode are glyceraldehyde, formate, lactate, or gluconate, respectively. US 2019/0127865 A1 describes a device and a method for the electrochemical reduction of carbon dioxide. The electrochemical device is configured to receive carbon dioxide and water and output reduction products of carbon dioxide at the cathode and oxygen or other oxidized products at the anode. The use of a bipolar membrane in order to prevent product cross-over and to promote auto dissociation of water is disclosed.

There remains a need in the art for the large-scale electrochemical production of formate, as to date no suitable and economically feasible processes are available. The present invention provides in this need.

SUMMARY

The inventors developed an electrochemical production process for formate. The inventors were able to couple the reduction of carbon dioxide into formate at the cathode to the oxidation of polyols, and even mixtures of polyols, into formate at the anode. As such, two streams that are typically regarded waste or surplus streams are made to good use in the production of formate. Further, since formate is formed at the cathode and at the anode, a product stream with a high concentration and purity of formate is obtained. Thus, since a high concentration of relatively pure formate is formed at both the cathode and at the anode, the electricity costs and capital expenses for formate production are strongly reduced compared to 'unpaired' processes (i.e., processes where only the anode or cathode produces concentrated formate streams). The process according to the invention can operate at high Faraday efficiencies at high current densities, thus enabling for the first time an economically viable process for the large-scale production of formate. In a preferred embodiment, the process according to the invention employs a biomass treatment waste stream, and thus also provides a solution for biomass valorisation.

The invention can be defined according to the following list of preferred embodiments:

1. A process for the electrochemical formation of formate, wherein the process is performed in an electrochemical cell comprising a cathode compartment containing a cathode, an anode compartment containing a nickel-based anode and an ion exchange membrane separating the anode compartment from the cathode compartment, and wherein the process comprises:
   (a) feeding an anolyte comprising at least one polyol to the anode compartment;
   (b) feeding a catholyte comprising $CO_2$ to the cathode compartment;
   (c) applying a voltage difference between the cathode and the anode such that at the cathode $CO_2$ is reduced to formate and at the anode the at least one polyol is oxidized to formate.
2. The process according to embodiment 1, wherein the anolyte comprises one or more of glycerol, sorbitol, erythritol, ethylene glycol and glucose.
3. The process according to any one of the preceding embodiments, wherein the anolyte comprises a mixture of two or more polyols.
4. The process according to any one of the preceding embodiments, wherein the anolyte is an industrial waste stream selected from biomass hydrolysis or biomass hydrogenation processes.
5. The process according to any one of the preceding embodiments, wherein the at least one polyol is sorbitol, erythritol, glucose and glycerol.
6. The process according to any one of the preceding embodiments, wherein the ion exchange membrane is a bipolar membrane.
7. The process according to any of the preceding embodiments, wherein the cathode is a gas diffusion electrode, and wherein the catholyte is a combination of gaseous $CO_2$ led through the gas diffusion electrode and a liquid catholyte comprising a base fed to the cathode compartment.
8. The process according to any of the preceding embodiments, wherein the cathode contains indium.
9. The process according to any of the preceding embodiments, wherein the anode contains nickel sulphide or nickel-molybdenum-nitride.
10. The process according to any of the preceding embodiments, wherein the product stream from the cathode and the product stream from the anode are combined into a single product stream comprising a formate solution.
11. The process according to any of the preceding embodiments, wherein the concentration of the at least one polyol in the anolyte is at least 0.01 M, preferably at least 0.02 M, more preferably at least 0.05 M, most preferably at least 0.08 M.
12. The process according to any of the preceding embodiments, wherein the concentration of the at least one polyol in the anolyte is at most 1 M, more preferably at most 0.5 M, even more preferably at most 0.4 M, yet even more preferably at most 0.3 M, most preferably at most 0.2 M.
13. The process according to any of the preceding embodiments, wherein the excess polyol substrate feed to the anode compartment is of from 5 to 200, preferably between 20 to 120, more preferably between 50 and 90, wherein the excess polyol substrate feed is defined as the ratio between the molar polyol substrate feed at the anode and the maximum rate of polyol substrate conversion at the anode.

DETAILED DESCRIPTION

Figure 1:
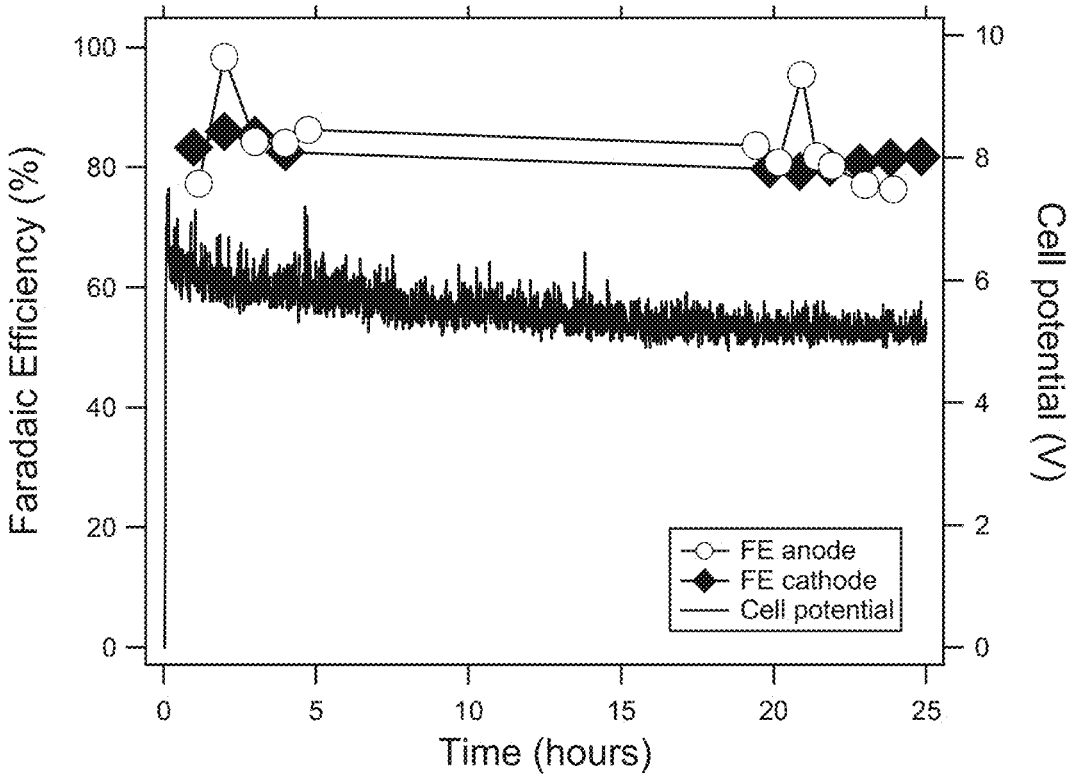
FIG. 1 displays the Faraday efficiency for the anodic and the cathodic reactions and the cell potential during an electrolysis experiment.

The inventors developed an electrochemical process for the production of formate. The process according to the invention can be used for the large-scale synthesis of formate, and affords formate in high yields and with little to no impurities or by-products. Also, the process of the invention is capable of converting waste streams into formate, with little need for purification. For the first time, such an electrochemical synthesis of formate is proposed, wherein little to no by-products are formed.

In the process according to the invention, $CO_2$ is reduced into formate at the cathode, and at the same time one or more polyols are oxidized into formate at the anode. The process according to the invention is performed in an electrochemical cell comprising a cathode compartment containing a cathode, an anode compartment containing a nickel-based anode and an ion exchange membrane separating the anode compartment from the cathode compartment. The process comprises:

(a) feeding an anolyte comprising at least one polyol to the anode compartment;

(b) feeding a catholyte comprising $CO_2$ to the cathode compartment;

(c) applying a voltage difference between the cathode and the anode such that at the cathode $CO_2$ is reduced to formate and at the anode the at least one polyol is oxidized to formate.

The cathode can be any cathode known in the art to be suitable for the reduction of $CO_2$ into formate. Such cathodes are known to the skilled person, e.g. from Hor et al. (*Electrochimica Acta,* 1994, 39, 1833-1839). Such cathodes may be referred to as catalytic cathodes, and typically contain at least one metal selected from Pb, In, Sn, Bi and Hg. In a preferred embodiment, the cathode contains at least In. The cathode may be an alloy, containing at least two metals. In one embodiment, the cathode contains a first metal selected from the group consisting of Pb, In, Sn, Bi and Hg and a second element selected from the group consisting of In, C, Pt, Pd, Rh, Mo, Zr, Nb, Os, Au, Ag, Ti, Cu, Ir, Ru, Re, Hg, Pb, Ni, Co, Zn, Cd, Sn, Fe, Cr, Mn, Ga, Tl, Sb, Ga and Bi. In a more preferred embodiment, the cathode contains a first metal selected from the group consisting of Pb, In, Sn, Bi and Hg and a second element selected from the group consisting of Sn, Pb, Ga and Bi. In an even more preferred embodiment, the cathode contains In as first metal and a second element selected from the group consisting of Sn, Pb, Ga and Bi. The atoms are typically present in their metallic form, although metal oxides, metal phosphides, metal nitrides and metal sulfides have also been known to reduce carbon dioxide. The cathode may contain further components, such as ligands to stabilize the metal atoms and/or to catalyse the reduction of $CO_2$, e.g. hydrides, halides, phosphines and porphyrins. Single metal cathodes may be used as well as alloys. Indium-containing alloys have been found particularly effective in the reduction of $CO_2$. Especially preferred cathodes are selected from indium cathodes, indium-bismuth cathodes, indium-tin cathodes and indium-lead cathodes. In a preferred embodiment, the catalytic cathode is an indium-bismuth catalyst, indium-tin catalyst or an indium catalyst, most preferably an indium-bismuth catalyst.

In a preferred embodiment, the cathode is an indium-bismuth cathode, wherein he amount of bismuth is in the range of 5-94 wt. % based on the total amount of bismuth and indium, preferably in the range of 10-90 wt. %, more preferably 30-90 wt. %, such as 35-90 wt. %, most preferably in the range of 40-60 wt. %, such as 45-55 wt. %. Such ratios have shown to provide improved catalytic properties regarding carbon dioxide to formate conversion, see e.g. WO 2019/141827. The catalyst can comprise a combination of bismuth and indium in different thermodynamic phases.

The cathode may be structured as a foam, felt and/or mesh. The cathode can consist of the catalytic material, but the catalytic material may also be deposited on a support, such as a carbon support. Preferably, the catalyst is applied in combination with an electrically conductive support. As a conductive support a particulate material, in particular carbon particles, may be used. Preferably the conductive support comprises a porous structure of carbon particles bonded together. A preferred binding material is a hydrophobic binder, such as a fluorinated binder. The catalyst is deposited onto or adhered to the conductive material. The weight ratio of metal, such as indium and/or bismuth, to carbon can advantageously be in the range of 0.10-1.50, preferably 0.2-0.8.

In a preferred embodiment, the cathode is a gas diffusion electrode (GDE). Gas diffusion electrodes are highly suitable for the reduction of $CO_2$, especially when $CO_2$ in gaseous form is used as electrolyte. A gas-diffusion electrode provides a high surface area or interface for solid-liquid-gas contact. Such a gas-diffusion electrode typically comprises an electrically conductive substrate, which may serve as a supporting structure for a gas-diffusion layer. The gas-diffusion layer provides a thin porous structure or network, e.g. made from carbon, for passing a gas like carbon dioxide from one side to the other. Typically the structure is hydrophobic to distract water. The gas diffusion layer may comprise the catalytically active material. By diffusion of gaseous $CO_2$ through the pores of the cathode, the area that is available for reducing $CO_2$ is maximized, as such increasing the overall efficacy of the process according to the invention. Additionally, the same gas inlet can be used to receiving air during the regeneration according to the present invention.

The gas diffusion electrode typically contains the indium-containing catalytic system embedded in the gas-diffusion layer or provided as one or more additional separate layers thereof. Examples of suitable substrates include metal structures like expanded or woven metals, metal foams, and carbon structures including wovens, cloth and paper. As explained above, the conductive support for the catalyst is preferably formed by particulate carbon. The catalyst system is preferably bonded to the electrically conductive substrate using a hydrophobic binder, such as PTFE.

The inventors found that polyol oxidation using a nickel-based anode could be coupled to the reduction of $CO_2$. Nickel-based anodes for the oxidation of a polyol are known in the art, e.g. from Weaver et al. (*J. Am. Chem. Soc.* 1991, 113, 9506-9513), Berchmans et al. (*J. Electroanal. Chem.* 1995, 394, 267-270) and Li et al. (*Nature Commun.* 2019, 10, 5335). It was found that the electrooxidation of polyol using a nickel-based anode results in improved selectivity over prior art anode materials, such as Pt based anodes, which are known to become poisoned during the process due to the formation of Pt—CO intermediates.

In addition to nickel, the anode may contain further elements, such as one or more elements selected from the group consisting of S, O, P, N, C, Si, Fe and Mo, preferably from the group consisting of S, O, P, N, C and Si. The atoms may be present in their metallic form, or in any other suitable form known in the art. In a preferred embodiment, the nickel is present in metallic form or as sulphide, oxide and/or hydroxide. The anode may contain further components, such as ligands to stabilize the metal atoms and/or to catalyse the oxidation of polyols, e.g. hydrides, halides, phosphines and porphyrins. Single metal nickel anodes may be used as well as alloys. Preferably, the anode contains nickel sulphide or nickel-molybdenum-nitride. Especially promising results have been obtained met nickel sulphide based anodes.

The anode may be structured as a foam, felt and/or mesh. Preferably, the anode contains nano-structured catalyst on nickel foam or on copper foam. These nano-structured anodes enable high Faraday efficiencies at high current densities. The anode can consist of the catalytic material, but the catalytic material may also be deposited on a support, such as a carbon or nickel support. Preferably, the catalyst is applied in combination with an electrically conductive support. As a conductive support a particulate material, in particular nickel particles, may be used. Preferably, the conductive support comprises a porous structure, such as particles bound together or a foam. A preferred binding material is a hydrophobic binder, such as a fluorinated binder. The catalyst is deposited onto or adhered to the conductive material. In case carbon is used in the support, the weight ratio of metal, including nickel, to carbon can advantageously be in the range of 0.10-1.50, preferably 0.2-0.8.

The electrochemical cell wherein the process according to the invention is performed, contains an anode compartment, containing the anode as defined hereinabove, and a cathode compartment, containing the cathode as defined hereinabove, which are separated by an ion exchange membrane. The membrane may be made from porous glass frit, microporous material, ion exchanging membrane or ion conducting bridge, and allows ionic species to travel from one compartment to the other, such as protons generated at the anode to the cathode compartment. Preferably, the membrane allows the passage of protons from the anode compartment to the cathode compartment.

In a preferred embodiment, the membrane is a bipolar membrane. Protons are released at the cathode side of the bipolar membrane, and hydroxide anions are released at the anode side of the bipolar membrane. The protons can be used for the reduction of $CO_2$ into formate at the cathode, while the hydroxide anions are recombined with a proton that is formed during the oxidation of the one or more polyols at the anode. As such, a net flow of protons from the anode to the cathode is provided.

Electrochemical cells are well-known in the art. They are equipped with an anode and a cathode and may comprise one or more semi-permeable membranes located in between the anode and cathode, as such forming an anode compartment and a cathode compartment. In operation, an oxidation reaction occurs at the anode and a reduction reaction occurs at the cathode. The process according to the invention may be a continuous process, preferably wherein a plurality of electrochemical cells are connected in parallel and wherein some of the cells are being subjected to regeneration while other cells are simultaneously used for operation.

In a preferred embodiment, the process is performed in an electrochemical cell assembly, comprising a plurality of electrochemical cells, each cell comprising an anode compartment and a cathode compartment, separated by one or more semi-permeable membranes, and a nickel-based anode and a cathode. Each cell contains an inlet for receiving anolyte to the anode compartment and an inlet for receiving catholyte to the cathode compartment, an outlet for discharging formic acid or a salt thereof.

Each electrochemical cell may contain a cathode compartment and an anode compartment separated by at least one membrane and wherein the cathode compartments contains the inlet for receiving either an electrolyte containing $CO_2$ to the gas diffusion electrode, and the anode compartment a separate inlet for receiving an anolyte. The membrane may be made from porous glass frit, microporous material, ion exchanging membrane or ion conducting bridge, and allows ionic species to travel from one compartment to the other, such as protons generated at the anode to the cathode compartment.

The electrochemical cell assembly may contain the plurality of electrochemical cells arranged in blocks, wherein each block typically contains an equal amount of electrochemical cells, preferably 1-25 electrochemical cells, most preferably 1 or 10 electrochemical cells. During operation, each block alternates between a first position wherein it is used for conversion of $CO_2$ to formic acid or a salt thereof, i.e. step (a) of the process according to the present invention, and a second position wherein it is regenerated, i.e. step (b) of the process according to the present invention.

The process according to the invention involves the regular operation of an electrochemical cell. Steps (a)-(c) are simultaneously performed in order to property operate the electrochemical cell. During this operation, carbon dioxide is converted into formate at the cathode and the polyol(s) are converted into formate at the anode. Regular operation of an electrochemical cell may further involve a regeneration step, wherein the cathode, the anode, or both, are regenerated in order to improve the yields obtained at the electrode(s) during operation and/or to improve the lifetime of the electrode(s). Such regeneration is known in the art.

During the operation stage, anolyte is fed to the anode compartment. The anolyte comprises at least one polyol, typically as aqueous solution. A polyol is herein defined as an organic compound containing at least two hydroxyl moieties which are α-β-positioned, i.e. connected to two adjacent carbon atoms. Such polyols having at least two α-β-positioned hydroxyl moieties are also called "α-β-polyols" or "vicinal polyols". In one embodiment, at least one polyol containing two or more α-β-hydroxyl moieties, such as 3 to 6 hydroxyl moieties, is comprised in the anolyte. Preferably, at least one polyol containing three or more hydroxyl moieties, such as 3 to 6 hydroxyl moieties, is comprised in the anolyte. Preferably, the polyol is a sugar alcohol, more preferably, the polyol is selected from the group consisting of one or more of glycerol, sorbitol, erythritol, ethylene glycol and glucose. In one embodiment, the polyol contains, preferably is, ethylene glycol. In one embodiment, the polyol contains, preferably is, glycerol. In one embodiment, the polyol contains, preferably is, glucose. In one embodiment, the polyol contains, preferably is, sorbitol. In one embodiment, the polyol contains, preferably is, erythritol. Especially promising results have been obtained with an anolyte wherein the polyol contains glycerol.

The inventors further surprisingly found that a mixture of polyols could be oxidized to formate. The oxidation of a mixture of polyols to formate offers a new option in the production of formate, wherein polyol containing waste streams can be used as feedstock for formate, without the need for extensively purifying such a waste stream. Thus, in one especially preferred embodiment, the anolyte comprises a mixture of at least two polyols, preferably at least three or even at least four polyols. In such a mixture, preferably at least one polyol, more preferably at least two, at least three or even at least four of the polyols, are selected from the group consisting of one or more of glycerol, sorbitol, erythritol, ethylene glycol and glucose. In case the anolyte contains a mixture of polyols, it is preferred that there are at least two, more preferably at least three or even at least four, polyols present with different amounts of hydroxyl moieties, such as a polyol having two hydroxyl moieties, a polyol containing three hydroxyl moieties, a polyol containing four hydroxyl moieties and a polyol containing six hydroxyl moieties.

In an especially preferred embodiment, the mixture comprises at least glycerol, sorbitol, erythritol. In this embodiment, the polyol fraction preferably comprises 50-100 wt % of glycerol, sorbitol and erythritol, more preferably 90-100 wt % of glycerol, sorbitol and erythritol, based on total weight of the polyols. In one embodiment, the mixture comprises at least glycerol, sorbitol, erythritol, ethylene glycol and glucose.

In a preferred embodiment, the anolyte thus originates from an industrial waste stream, such as biomass hydrolysis or biomass hydrogenation processes. Such streams typically contain residual glycerol and/or glucose that can be oxidized to formate in the process according to the invention. The process according to the invention thus provides for an efficient way of increased biomass valorisation. Importantly, the process according to the invention allows for the presence of alkali metal salts, such as $K^+$ and $Na^+$, which are typically present in a polyol waste stream and would normally need to be removed in case the polyols would be subjected to a conventional catalytic conversion. Thus, in a preferred embodiment, the anolyte comprises an alkali metal cation, preferably $K^+$ or $Na^+$. It is further preferred that the pH of the anolyte is not too low, such as in the range of 7-14, to avoid electrode corrosion.

During the operation stage, catholyte is fed to the cathode compartment. The catholyte used in the process according to the invention comprises carbon dioxide. The $CO_2$ that is comprised in the catholyte may originate from any source. In a preferred embodiment, the $CO_2$ originates from exhaust gases, flue gases or air. Typically, the $CO_2$ originates from industrial flue gases, such as from power plants or the chemical industry. $CO_2$ can be captured from exhaust gases, flue gases and air by methods known in the art. In case the $CO_2$ is provided via a gas diffusion electrode as the electrode according to the present invention, it is preferred that the concentration of $CO_2$ in the gas is as high as possible, such as above 90 wt %, preferably above 95 wt %, more preferably above 99% wt % or even above 99.9 wt %. In addition to $CO_2$, some other gaseous species may be present, such as inert gases ($N_2$, Ar) and/or $H_2$. The presence of 02 in the gas fed to the electrode is preferably avoided.

In one embodiment, the process according to invention employs a gas diffusion electrode as cathode, wherein the catholyte is a combination of gaseous $CO_2$ led through the gas diffusion electrode and a liquid catholyte comprising a base fed to the cathode compartment. The semi-permeable membranes may be connected directly to the gas diffusion electrode. Such a set-up of the cathode compartment has been found especially beneficial when using gaseous $CO_2$ as (part of the) catholyte.

In the process according to the invention, a voltage difference is applied between the cathode and the anode such that at the cathode $CO_2$ is reduced to formate and at the anode the at least one polyol is oxidized to formate. The reduction of $CO_2$ to formic acid is known in the art. The half reaction is typically as follows: $CO_2+2H^++2e^-\rightarrow HCO_2H$ [$E^0=-0.20$ V vs. RHE]. The carbon dioxide is supplied to the cathode and consumed there. $CO_2$ can be fed in liquid or gaseous form. The solution of carbon dioxide may be aqueous or non-aqueous and may include buffers such as bicarbonates and/or phosphates. Non-aqueous electrolytes have been found beneficial in the reduction of $CO_2$ as the side-reaction at higher potentials wherein $H_2$ is formed (due to reduction of protons in solution) is reduced. $CO_2$ gas can also be fed to the cathode compartment through gas diffusion electrode (GDE). Neutral pH was found to give the best results in terms of $CO_2$ reduction. In one preferred embodiment, the cathode is a GDE and is fed with a gaseous catholyte. In an alternative preferred embodiment, the catholyte is aqueous and liquid catholyte is present in the cathode compartment. It is well-known to the skilled person to select specific electrochemical conditions (e.g. the voltage applied and catholyte composition) in order to optimize the formation of formate.

An electrical potential is applied between the anode and the cathode. The anode is positively charged and the cathode negatively. In other words, an electrical potential to the electrochemical cell so that the anode is at a higher potential than the cathode. Cations, typically protons, will thus flow from the anode towards the cathode where they combine with a molecule of $CO_2$ to form a formic acid molecule. Electrons, liberated at the anode by the anodic reaction, are taken up by the anode, while they are transferred to the cathode to be combined with the protons and oxygen atoms into water molecules and the product of the $CO_2$ reduction (formate). The electrical potential may be a DC voltage. In preferred embodiments, the applied electrical potential is generally between about 1 V and about 6 V, preferably from about 1 V to about 5 V, such as in the range of 3 V to 5 V and more preferably from about 1.5 V to about 4 V.

It is noted that applying an electrical potential is considered synonymous with creating a voltage difference between the cathode and the anode, so that the anode is at a higher potential than the cathode. The process may be controlled by setting a certain voltage (galvanostatic) or by setting a certain current (potentiostatic). If the voltage is set, the current will automatically follow from the reactions that occur in the cell. If the current is set, the voltage will automatically follow from the reactions that occur in the cell. The process according to the invention is equally workable in both operation modes. Typically, the current is controlled in the start-up phase of an electrochemical cell, in order to find the optimal voltage for the desired reaction, while during standard operation of the electrochemical cell, the voltage will be controlled. The process according to the invention operates with such a voltage difference and/or such a current that carbon dioxide is reduced at the cathode and the one or more polyols are reduced at the anode.

Preferably, the current density of the electrochemical cell during operation is at least 10 mA/cm$^2$, such as in the range of 10 mA/cm$^2$-5 A/cm$^2$, more preferably at least 100 mA/cm$^2$, such as in the range 100 mA/cm$^2$-3 A/cm$^2$. A certain minimal current, typically at least 10 mA/cm$^2$, preferably at least 100 mA/cm$^2$, is preferred in terms of process economics, as below these values too little product is formed for an economically viable process. The upper limit of the current at which the process can operate is solely determined by safety issues. For example, it the current is too high, the cell may heat up too much. Other than that, higher currents are preferred since it will result in more product formation. Excellent results have been obtained with a current density in the range of 50-200 mA/cm$^2$. Herein, the currents are defined based on the projected area of the electrode. The optimal current for the process according to the invention may differ based on the exact conditions that are applicable in the electrochemical cell, and the skilled person is able to determine the optimal current in terms of product conversions.

The process according to the invention is preferably performed at or near ambient pressure and temperature, although deviation from these conditions is possible without significantly affecting the process. In one embodiment, the temperature during the operation of the electrochemical cell is in the range of 10-50° C., preferably 15-40° C.

In one embodiment, the process according to invention is performed such that the concentration of the at least one polyol in the anode compartment is maintained within predefined boundaries. It has been reported that formate produced in the anodic process is prone to further oxidation to $CO_2$, which may form carbonate or bicarbonate by reaction with hydroxide (Li et al. Nature Commun. 2019, 10, 5335). This over oxidation of formate may reduce the formate yield and Faraday efficiency and impede the formation of product streams with high concentrations of formate. It was surprisingly found by the present inventors that maintaining a minimum concentration of polyol in the anode compartment can slow down or inhibit the undesired (over)oxidation of formate to carbon dioxide. In one embodiment, the concentration of the at least one polyol in the anolyte is at least 0.01 M, preferably at least 0.02 M, more preferably at least 0.05 M, most preferably at least 0.08 M. It is further presumed that with increasing polyol concentration the Faraday efficiency of the process is decreased. In one embodiment, the concentration of the at least one polyol in the anolyte is at most 1 M, more preferably at most 0.5 M, even more preferably at most 0.4 M, yet even more preferably at most 0.3 M, most preferably at most 0.2 M.

In one embodiment, the flow rate of the polyol substrate to the anode is controlled by supplying during the process the one or more polyols to the anode at a rate that is proportional to the rate of conversion at the anode. The ratio between the molar polyol substrate feed at the anode and the maximum rate of substrate conversion may be referred to as the excess substrate feed, and is expressed by the following equation:

$$\text{Excess Substrate Feed} = \frac{[polyol] * \dot{V}}{I/nF}$$

Herein, [polyol] is the (steady state) polyol concentration in the anolyte (M), V is the anolyte flow rate (L s$^{-1}$), I is the current (A), n is the number of electrons involved in the oxidation of one polyol molecule (e.g., n=8 for formation of 3 formate from glycerol), and F is the Faraday constant. In one embodiment, the Excess Substrate Feed (ESF) is maintained in the range between 5 to 200, preferably between 20 to 120, more preferably between 50 and 90.

The process according to the invention affords formate, such as sodium formate or potassium formate. The formate may be formed with any counter ion, which depends on the base used in the catholyte. In the absence of base, formic acid may be formed, which is considered indistinguishable from formate in the context of the present invention. Since both the cathodic reaction and the anodic afford formate, the cathodic product stream and the anodic product stream are preferably combined in a single product stream, which is a formate solution. Thus, in one embodiment of the process of the present invention, at least a part, preferably substantially all, or all, of the product stream from the cathode and at least a part, preferably substantially all, or all, of the product stream from the anode are combined to form a single formate-containing product stream.

The process according to the invention, wherein the electrooxidation of the one or more polyols is performed using a nickel-based anode, and preferable further using control of the anolyte polyol concentration and/or the excess polyol substrate feed as defined above, allows for high selectivity and yield of formate, without any substantial over-oxidation of formate to e.g., carbon dioxide. In conjunction with the concurrent electroreduction of carbon dioxide to formate at the cathode as described herein, the co-electrolytical formation of formate according to the invention advantageously provides a single product stream comprising a high concentration of desired formate product and minimal amounts of undesired by-products. This in turn results in reduced downstream separation and purification requirements. The product stream typically comprises formate in a concentration of 40-100 wt % based on total dry weight, preferably 50-99 wt %, more preferably 60-98 wt % or even 70-95 wt %.

EXAMPLES

Example 1

A nickel sulfide on nickel foam ($Ni_3S_2$/NF) anode was prepared by depositing nickel sulfide on nickel foam by hydrothermal treatment of the nickel foam with thiourea. Indium and bismuth catalyst for the cathode was prepared as described in WO 2019/141827. The gas diffusion electrode was prepared as described in US 2014/0227634 A1. Indium and bismuth nanoparticles were obtained by chemical reduction of their salts. After purification of the nanoparticles, a suspension of these nanoparticles was sprayed on a carbon-based gas diffusion layer.

The anode and cathode (both 9.25 cm$^2$) were placed in a filter-press, three-compartment electrochemical cell. A flow of $CO_2$ was led through compartment A (50 mL/min). Through compartment B 0.1 M $KHCO_3$ (the catholyte) was recirculated (50 mL/min). Through compartment C 1 M KOH with 0.050 M glycerol (the anolyte) was recirculated (140 mL/min). Compartment A and B were separated by the cathode. Compartment B and C were separated by an ion-exchange membrane (Fumasep bipolar membrane).

Compartment C contains the anode. In compartment B and C a plastic mesh was placed to fill the gap between electrodes and membrane.

Constant current electrolysis (100 mA/cm$^2$) was performed. The anolyte and catholyte are periodically sampled for analysis of formate and glycerol (only the anolyte) concentrations. The formate concentration is analysed with ion-exchange chromatography. The glycerol concentration is analysed with liquid chromatography. FIG. 1 depicts the Faraday efficiency for the anodic and the cathodic reactions (left axis) and the cell potential (right axis).

Example 2

A nickel sulphide on nickel foam ($Ni_3S_2$/NF) anode (1 cm$^2$) and platinum gauze cathode (4 cm$^2$) were placed in a separate compartment of a glass H-cell, in which the compartments were separated by a glass porous frit. The compartment with the $Ni_3S_2$/NF anode (the anodic compartment) is filled with an aqueous solution of 1 M KOH and 0.050 M of the polyol substrate. The compartment with the platinum gauze (the cathodic compartment) was filled with 1 M KOH. The anodic compartment was stirred with magnetic stirrer (1000 rpm). Constant current electrolysis was performed with varying current densities (50-150 mA/cm$^2$). The solutions from the anodic and cathodic compartment ware analysed with ion-exchange chromatography to analyse the formate concentration. The maximum Faraday efficiency for each substrate at different current density is provided in the table below:

| Substrate | Current dens. (mA/cm$^2$) | FE (%) |
|---|---|---|
| Ethylene glycol | 50 | 98 |
| Ethylene glycol | 100 | 92 |
| Glycerol | 100 | 86 |
| Glycerol | 150 | 90 |
| Glucose | 50 | 84 |
| Glucose | 100 | 83 |
| Sorbitol | 100 | 77 |

Example 3

Figure 2:
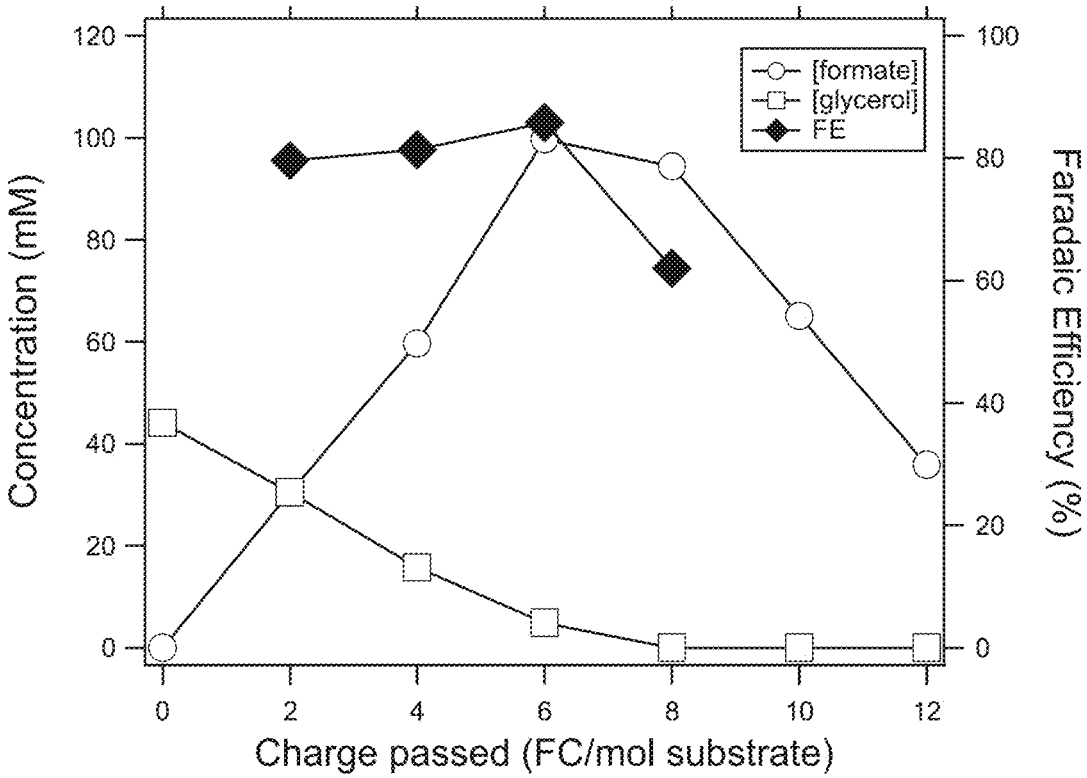
FIG. 2 displays the concentration profile and Faradaic Efficiency (FE) during an electrolysis experiment.

Identification of the products of glycerol oxidation on $Ni_3S_2$/NF was performed by electrolysis in a glass H-cell as described above and monitoring of the product and substrate concentrations with high-performance liquid chromatography (HPLC) and ion exchange chromatography (IC). The duration of the electrolysis experiment was expressed in Faraday of charge (FC) passed (Q) per molecule of substrate. This charge (Q) is expressed in FC/mol of substrate, where F is the Faraday constant and C is charge in Coulombs (C). A theoretical full conversion of glycerol to 3 formate ions corresponds to the passing of 8 electrons per molecule of substrate, or 8 FC/mol. FIG. 2 (left axis) depicts the concentration profile during an electrolysis experiment where a constant current of 100 mA/cm$^2$ is applied. FIG. 2 further depicts (right axis) the Faradaic Efficiency (FE) during the same experiment. It is observed that the FE decreases after 6 FC/mol due to decreasing formate concentration resulting from over oxidation to $CO_2$.

Example 4

A nickel sulfide on copper foam ($Ni_3S_2$/NF) anode was prepared by depositing nickel sulfide on copper foam. Indium and bismuth catalyst for the cathode was prepared as described in WO 2019/141827. The gas diffusion electrode was prepared as described in US 2014/0227634 A1. Indium and bismuth nanoparticles were obtained by chemical reduction of their salts. After purification of the nanoparticles, a suspension of these nanoparticles was sprayed on a carbon-based gas diffusion layer.

The anode and cathode (both 95 cm$^2$) were placed in a filter-press, three-compartment electrochemical cell. A flow of $CO_2$ was led through compartment A (0.3 standard liter per minute). Through compartment B 0.1 M $KHCO_3$ (the catholyte) was recirculated (414 mL/min). Through compartment C, 3 M KOH with 0.10 M glycerol (the anolyte) was recirculated (758 mL/min). Compartment A and B were separated by the cathode. Compartment B and C were separated by an ion-exchange membrane (Fumasep bipolar membrane). Compartment C contains the anode. In compartment B and C a plastic mesh was placed to fill the gap between electrodes and membrane.

Figure 3:
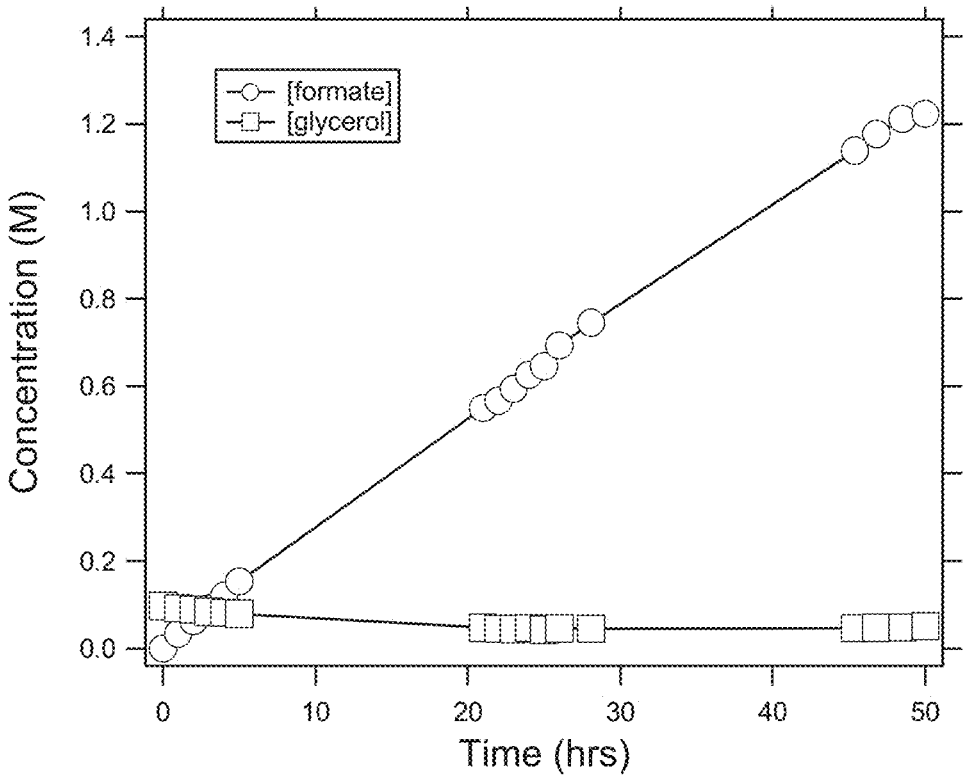
FIG. 3 displays the formate and glycerol concentrations at the anode in an electrolysis experiment with control of the glycerol concentration.
Figure 4:
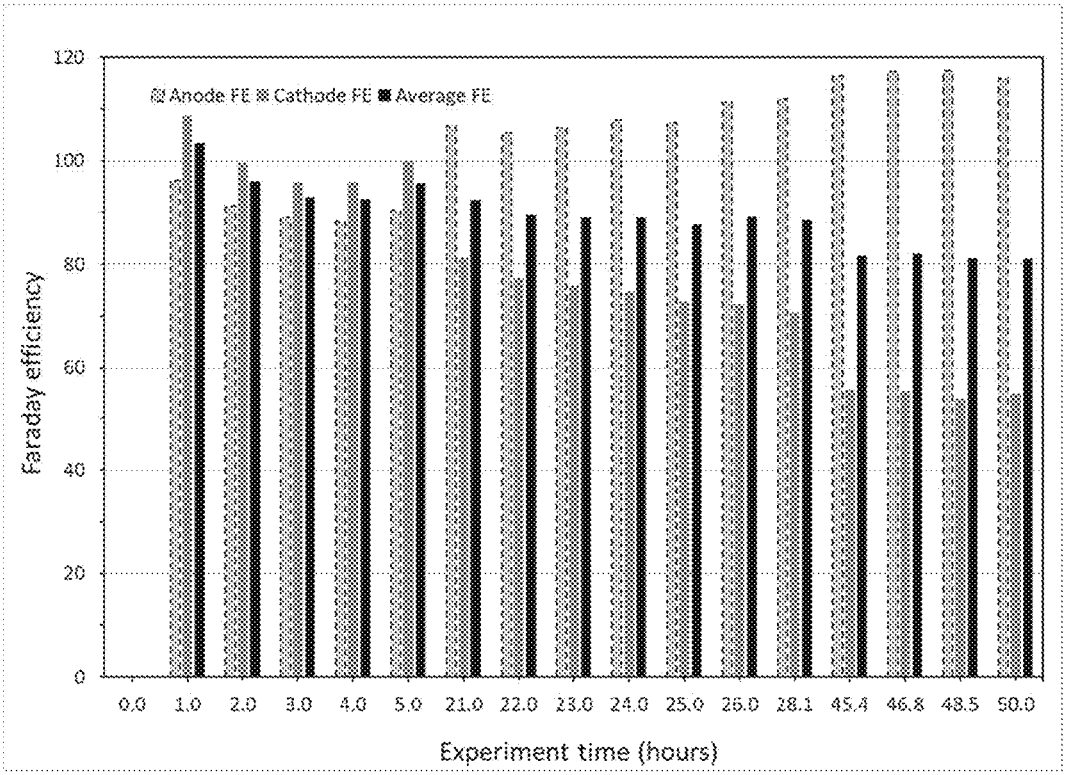
FIG. 4 displays the apparent Faraday efficiencies of the anode and cathode in an electrolysis experiment with control of the glycerol concentration and the theoretical averaged Faraday efficiency of the combined product streams.

Constant current electrolysis (100 mA/cm$^2$) was performed for 50 hours. During the experiment, a constant volume (0.273 mL/min) of 20 w % glycerol in water was added to maintain the glycerol concentration between 0.045 and 0.100 M. The anolyte and catholyte were periodically sampled for analysis of formate and glycerol (only the anolyte) concentrations. The formate concentration was analysed with ion-exchange chromatography. The glycerol concentration was analysed with liquid chromatography. During this experiment transport of formate through the ion-exchange membrane from the cathode to the anode was observed, resulting in a formate concentration at the anode of 1.2 M (corresponding to >100% Faraday efficiency) and a formate concentration corresponding to <55% Faraday efficiency at the cathode. After electrolysis the product streams of the anode and cathode were combined. The formate concentration in the combined stream corresponds to an average Faraday efficiency of 81% after 50 hours. This shows that high product concentration at the anode (1.2 M) can be obtained by maintaining a low concentration of glycerol for abating formate oxidation. FIG. 3 depicts the formate and glycerol concentrations at the anode. FIG. 4 depicts the apparent Faraday efficiencies of the anode and cathode, and the theoretical averaged Faraday efficiency of combined product streams.

Figure 5:
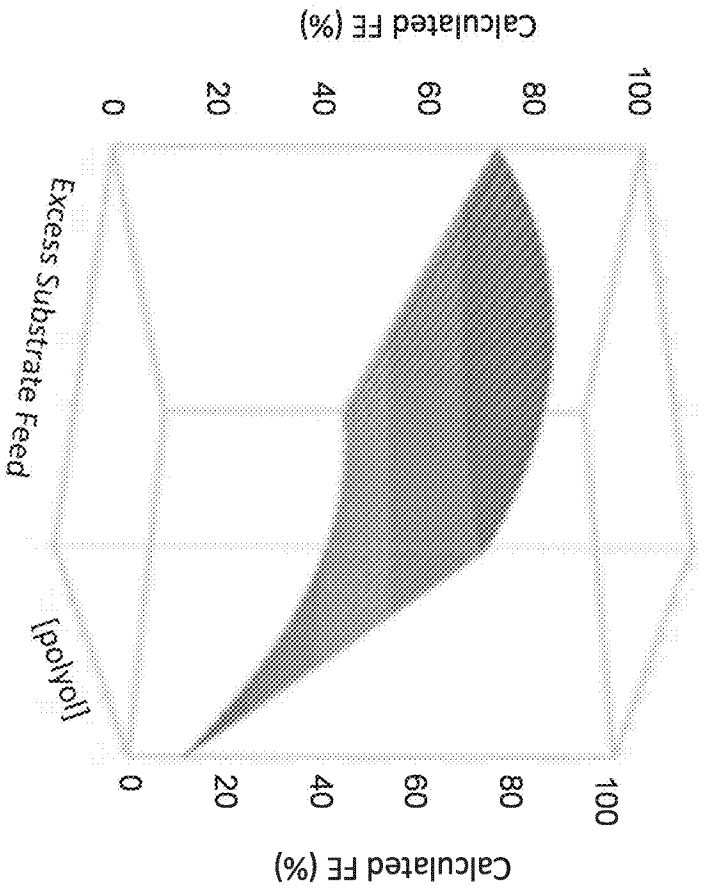
FIG. 5 displays the dependence of the calculated faradic efficiency (FE) on both the glycerol substrate concentration and the excess glycerol substrate feed.

A Design of Experiments (DoE) was constructed using JMP statistical software to study the influence of substrate concentration and excess feed on the faradic efficiency (FE) of the electrooxidation of glycerol to formate. FE was determined at 33%, 66% and 99% of theoretical full conversion (corresponding to 2.7, 5.3 and 8 FC/mol). The flow simulations were performed in batch mode with recirculation of the electrolytes through the electrochemical cell. The flow rate V of each experiment was set by solving the excess substrate feed equation as defined above at the initial substrate concentration. FIG. 5 displays the dependence of the calculated faradic efficiency (FE) on both the glycerol substrate concentration and the excess glycerol substrate feed. It is observed that at different initial glycerol concentrations the optimum faradic efficiency (FE) of the electrooxidation process is obtained at different values of the excess substrate feed.

The invention claimed is:

1. A process for the electrochemical formation of formate, wherein the process is performed in an electrochemical cell comprising a cathode compartment containing a cathode, an anode compartment containing a nickel-based anode and an ion exchange membrane separating the anode compartment from the cathode compartment, and wherein the process comprises:

(a) feeding an anolyte comprising at least one polyol to the anode compartment at an excess polyol substrate feed from 5 to 200, wherein the excess polyol substrate feed is defined as the ratio between a molar polyol substrate feed at the anode and a maximum rate of polyol substrate conversion at the anode, which excess polyol substrate feed is expressed by the equation:

$$\text{Excess Substrate Feed} = \frac{[polyol] * \dot{V}}{I / nF}$$

wherein, [polyol] is the steady state polyol concentration in the anolyte (M), V is the anolyte flow rate (L $s^{-1}$), I is the current (A), n is the number of electrons involved in the oxidation of one polyol molecule and F is the Faraday constant;

(b) feeding a catholyte comprising carbon dioxide to the cathode compartment; and (c) applying a voltage difference between the cathode and the anode, wherein, at the cathode, carbon dioxide is reduced to formate and at the anode the at least one polyol is oxidized to formate.

2. The process according to claim 1, wherein the concentration of the at least one polyol in the anolyte is at least 0.01 M.

3. The process according to claim 1, wherein the concentration of the at least one polyol in the anolyte is at most 1 M.

4. The process according to claim 1, wherein the excess polyol substrate feed at the anode is from 20 to 120.

5. The process according to claim 1, wherein the at least one polyol is one or more of glycerol, sorbitol, erythritol, ethylene glycol and glucose.

6. The process according to claim 1, wherein the anolyte comprises a mixture of two or more polyols.

7. The process according to claim 1, wherein the anolyte is an industrial waste stream selected from biomass hydrolysis or biomass hydrogenation processes.

8. The process according to claim 1, wherein the anolyte comprises sorbitol, erythritol, glucose and glycerol.

9. The process according to claim 1, wherein the ion exchange membrane is a bipolar membrane.

10. The process according to claim 1, wherein the cathode is a gas diffusion electrode, and wherein the catholyte is a combination of gaseous carbon dioxide led through the gas diffusion electrode and a liquid catholyte comprising a base fed to the cathode compartment.

11. The process according to claim 1, wherein the cathode contains indium.

12. The process according to claim 1, wherein the anode contains nickel sulphide or nickel-molybdenum-nitride.

13. The process according to claim 1, wherein a product stream from the cathode and a product stream from the anode are combined into a single product stream comprising a formate solution.

* * * * *